US011466952B2

(12) United States Patent
Tiziani

(10) Patent No.: US 11,466,952 B2
(45) Date of Patent: Oct. 11, 2022

(54) FIREARM SILENCER

(71) Applicant: Enfield Rifle Company, LLC, Statesboro, GA (US)

(72) Inventor: Michael Robert Tiziani, Pooler, GA (US)

(73) Assignee: ENFIELD RIFLE COMPANY, LLC, Statesboro, GA (US)

( * ) Notice: Subject to any disclaimer, the term of this patent is extended or adjusted under 35 U.S.C. 154(b) by 0 days.

(21) Appl. No.: 17/210,278

(22) Filed: Mar. 23, 2021

(65) Prior Publication Data

US 2022/0034619 A1 Feb. 3, 2022

Related U.S. Application Data

(63) Continuation-in-part of application No. 16/433,416, filed on Jun. 6, 2019.

(60) Provisional application No. 62/683,072, filed on Jun. 11, 2018.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32
See application file for complete search history.

(56) References Cited

U.S. PATENT DOCUMENTS

| | | | | |
|---|---|---|---|---|
| 4,588,043 | A * | 5/1986 | Finn | F41A 21/30 89/14.4 |
| 4,974,489 | A * | 12/1990 | Fishbaugh | F41A 21/30 89/14.4 |
| 5,164,535 | A * | 11/1992 | Leasure | F41A 21/30 89/14.4 |
| 8,087,338 | B1 * | 1/2012 | Hines | F41A 21/36 89/14.3 |
| 8,167,084 | B1 * | 5/2012 | Moore | F41A 21/30 181/223 |
| 9,038,770 | B1 * | 5/2015 | Morrison | F41A 21/30 89/14.4 |
| 9,194,640 | B2 * | 11/2015 | Wirth | F41A 21/30 |
| 9,366,495 | B1 * | 6/2016 | Coppinger | F41A 21/30 |
| 9,482,483 | B2 | 11/2016 | Whelan | |
| 10,024,617 | B1 * | 7/2018 | Moore | F41A 21/30 |
| 10,054,384 | B1 * | 8/2018 | Marfione | F41A 21/30 |
| 10,330,417 | B2 | 6/2019 | Reis Green et al. | |
| 10,619,962 | B1 * | 4/2020 | Hatfield | F41A 21/44 |

(Continued)

*Primary Examiner* — Derrick R Morgan
(74) *Attorney, Agent, or Firm* — Bennet K. Langlotz; Langlotz Patent & Trademark Works, LLC

(57) ABSTRACT

Firearm silencers have an elongated body defining an interior space and having a rear end with a mounting facility, and a forward end defining an exit aperture, the elongated body defining a plurality of baffle receptacles in the interior space, a first set of baffles received in some of the baffle receptacles, at least a second set of baffles received in some of the baffle receptacles, at least some of the baffles of the first set defining a bullet passage having a first diameter, at least some of the baffles of the second set defining a bullet passage having a different second diameter, and the baffle receptacles configured to securely receive all of the baffles of the first and second sets, all of the baffles of the first set and none of the second set, and all of the baffles of the second set and none of the first set.

15 Claims, 3 Drawing Sheets

(56) References Cited

U.S. PATENT DOCUMENTS

| | | | | |
|---|---|---|---|---|
| 2013/0168181 | A1* | 7/2013 | Wirth | F41A 21/30<br>181/223 |
| 2013/0175113 | A1* | 7/2013 | Hines | F41A 21/36<br>181/223 |
| 2015/0267987 | A1* | 9/2015 | Gawencki | F41A 21/30<br>89/14.2 |
| 2016/0018177 | A1* | 1/2016 | Powell | F41A 21/30<br>89/14.4 |
| 2019/0078852 | A1* | 3/2019 | Peknik | F41A 21/30 |
| 2019/0195590 | A1* | 6/2019 | Adamson, Jr. | F41A 21/30 |
| 2019/0293376 | A1* | 9/2019 | Crown | F41A 21/30 |
| 2019/0376758 | A1* | 12/2019 | Tiziani | F41A 21/34 |
| 2020/0173750 | A1* | 6/2020 | Riley | F41A 21/30 |
| 2020/0284540 | A1* | 9/2020 | Doerr | F41A 21/30 |
| 2020/0326148 | A1* | 10/2020 | Miele | F41A 21/30 |
| 2021/0341246 | A1* | 11/2021 | Kunsky | F41A 21/30 |
| 2021/0341247 | A1* | 11/2021 | Bowers | F41A 21/30 |
| 2021/0381792 | A1* | 12/2021 | Young | F41A 21/30 |
| 2022/0034619 | A1* | 2/2022 | Tiziani | F41A 21/30 |

* cited by examiner

FIREARM SILENCER

CROSS-REFERENCE TO RELATED APPLICATION

This application is a Continuation-in-Part of U.S. patent application Ser. No. 16/433,416 filed on Jun. 6, 2019, entitled "MULTI-CALIBER FIREARM SILENCER," which claims the benefit of U.S. Provisional Patent Application No. 62/683,072 filed on Jun. 11, 2018, entitled "Multi-Caliber Firearm Silencer," which are hereby incorporated by reference in their entirety for all that is taught and disclosed therein.

FIELD OF THE INVENTION

The present invention relates to firearms, and more particularly to a firearm silencer that utilizes a modular baffle core system to enable use of the silencer with a variety of different ammunition calibers.

BACKGROUND AND SUMMARY OF THE INVENTION

Firearm silencers greatly reduce the audible report from the explosion that occurs when discharging a firearm cartridge. They also suppress the muzzle flash associated with burning gunpowder exiting the barrel of the firearm. Because silencers allow the user to operate firearms without the need for hearing protection, they have become very popular for use in military, law enforcement and civilian applications.

Silencers would be even more popular for civilian use if not for the expense associated with acquiring them. Not only are they costly to produce, therefore demanding a high price, the legal requirements as outlined by the National Firearms Act (NFA) adds financial burden, additional documentation, and a long waiting period for Federal approval. To obtain a single silencer, one must complete Bureau of Alcohol, Tobacco, Firearms and Explosives forms and pay for a $200 tax stamp. Since most silencers are designed for specific ammunition calibers or caliber classes (i.e., a 30 caliber silencer may accommodate .308, 30-06, 300 Win Mag, etc. ammunition), multiple compatible silencers are ordinarily required if an individual wants one for a 45 cal. pistol, a 5.56 carbine, and a 30 cal. rifle.

There are a few prior art silencers that claim to be universal or multi-caliber silencers. This means they default to the largest bore size for the caliber range they accommodate, knowing all smaller caliber projectiles will be able to pass through the silencer. However, silencers with oversized bores do not function optimally. In the case of a relatively small caliber cartridge fired through a larger caliber silencer, the otherwise unneeded silencer bore diameter makes the silencer inefficient at suppressing noise. The excess bore diameter allows hot gases and sound waves to escape faster in the excess space between the fired projectile and the interior baffles, resulting in a louder discharge noise than a silencer more closely sized to the projectile. Therefore, caliber class-sized silencers are more effective and therefore desirable than existing universal or multi-caliber silencers.

Because the NFA dictates all silencer parts are subject to the regulations, spare silencer parts such as baffles are tightly controlled. Therefore, buying additional baffles in other calibers to interchange in a silencer cannot be done without the aforementioned licensing process and expense.

Therefore, a need exists for a new and improved firearm silencer that enables the use of multiple ammunition calibers without compromising the noise reduction effectiveness of the silencer. In this regard, the various embodiments of the present invention substantially fulfill at least some of these needs. In this respect, the firearm silencer according to the present invention substantially departs from the conventional concepts and designs of the prior art, and in doing so provides an apparatus primarily developed for the purpose of enabling the use of multiple ammunition calibers without compromising the noise reduction effectiveness of the silencer.

The present invention provides an improved firearm silencer, and overcomes the above-mentioned disadvantages and drawbacks of the prior art. As such, the general purpose of the present invention, which will be described subsequently in greater detail, is to provide an improved firearm silencer that has all the advantages of the prior art mentioned above.

To attain this, the preferred embodiment of the present invention essentially comprises an elongated body defining an interior space and having a rear end with a mounting facility, and a forward end defining an exit aperture, the elongated body defining a plurality of baffle receptacles in the interior space, a first set of baffles received in some of the baffle receptacles, at least a second set of baffles received in some of the baffle receptacles, at least some of the baffles of the first set defining a bullet passage having a first diameter, at least some of the baffles of the second set defining a bullet passage having a second diameter different from the first diameter, the baffle receptacles configured to securely receive all of the baffles of the first and second sets, the baffle receptacles configured to securely receive all of the baffles of the first set and none of the second set, and the baffle receptacles configured to securely receive all of the baffles of the second set and none of the first set. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
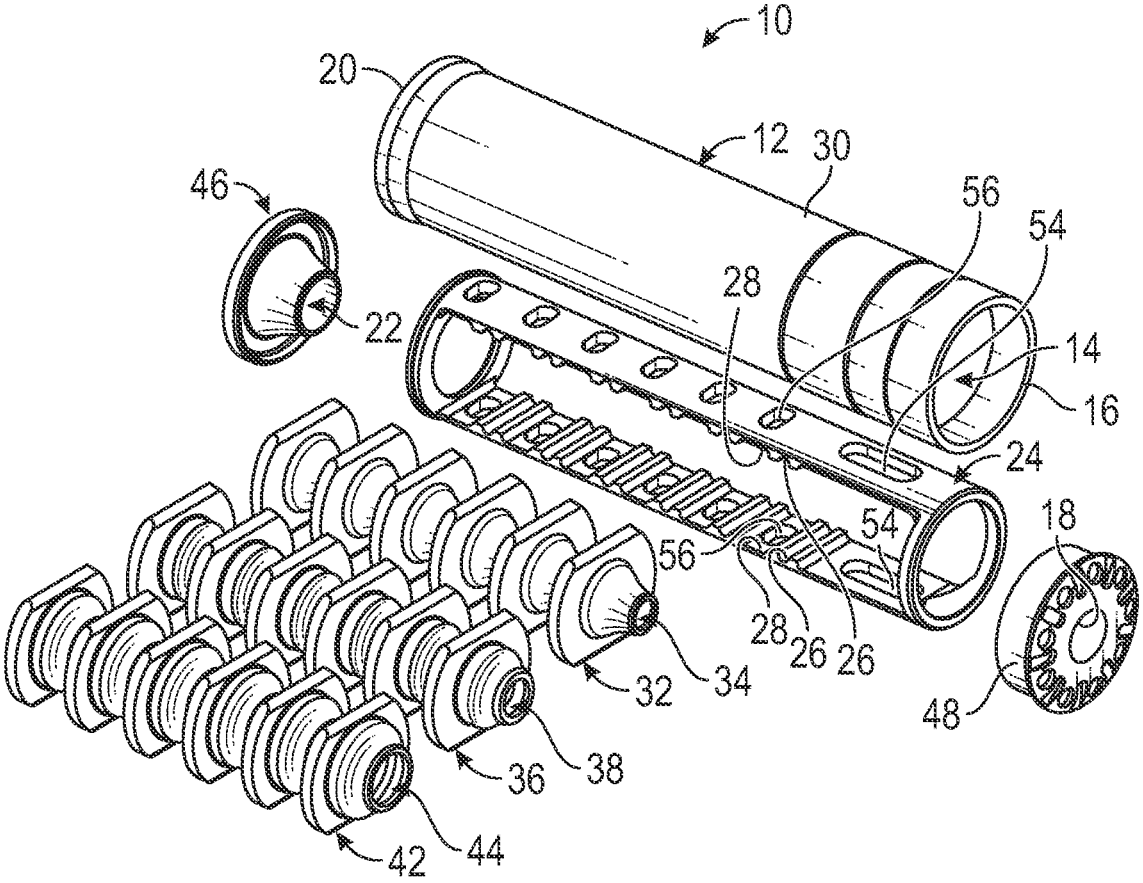
FIG. 1 is an exploded view of the current embodiment of a firearm silencer constructed in accordance with the principles of the present invention.

An embodiment of the firearm silencer of the present invention is shown and generally designated by the reference numeral 10.

FIG. 1 illustrates the improved firearm silencer 10 of the present invention. More particularly, the firearm silencer has an elongated, hollow cylindrical body 12 defining an interior space 14 and having a rear end 16 with a mounting facility 18, and a forward end 20 defining an exit aperture 22 in an end cap 46. The elongated body includes an inner element 24 defining a plurality of baffle receptacles 26, 28 and an outer sleeve 30 encompassing the inner element. A first set of baffles 32 is received in some of the baffle receptacles. At least some of the baffles of the first set define a bullet passage 34 having a first diameter. A second set of baffles 36 is received in some of the baffle receptacles. At least some of the baffles of the second set define a bullet passage 38 having a second diameter different from the first diameter. The baffle receptacles are configured to securely receive all of the baffles of the first and second sets, which means both sets of baffles can be simultaneously received in the baffle receptacles. The baffle receptacles are also configured to securely receive all of the baffles of the first set and none of the second set and are also configured to securely receive all of the baffles of the second set and none of the first set. The bullet passages of all of the baffles are registered with each other on a line 40 when the baffles are received in the baffle receptacles (shown in FIGS. 2-6). The firearm silencer can be configured such that all the baffles of only one of the first and second sets spaced apart over a majority of the length of the elongated body. At least some of the baffle receptacles (the larger baffle receptacles 28) are configured to closely receive a stack of a plurality of baffles. At least some of the baffle receptacles are configured to closely receive only a single baffle (the smaller baffle receptacles 26). In the current embodiment, the baffle receptacles are defined as transverse slots in the elongated body. Each set of baffles can consist of at least five baffles, and six baffles are preferred. There can be a third set of baffles 42 defining a bullet passage 44 having a third diameter different from the first and second diameters. It should be appreciated that each baffle of the three sets of baffles have a common width to be compatible with the baffle receptacles. It should also be appreciated that each baffle of the three sets of baffles has curved sides and a flat top and bottom to be compatible with both types of baffle receptacles and to not protrude from the inner element 24 when installed. The mounting facility is a threaded aperture defined in a muzzle attachment end cap 48 in the current embodiment and threadedly engages the standard muzzle threads on a host firearm (not shown).

The baffle receptacles 26, 28 can be viewed as being divided into two pluralities with the first plurality of baffles consisting of baffle receptacles 28 securely receiving a plurality of baffles 32, 36, and/or 42. The second plurality of baffle receptacles consisting of baffle receptacles 26 is each configured to securely receive at most half of the baffles, with a remainder of baffles removed from the elongated body 12. The second plurality of baffle receptacles are in a spaced-apart arrangement along a majority of the length of the elongated body in the current embodiment. Each of the first plurality of baffle receptacles is configured to receive a stack of at least two baffles. Each of the second plurality of baffle receptacles is configured to closely receive only a single baffle. Each of the first plurality of baffle receptacles has a width that is an integral multiple of a width of each of the second baffle receptacles in the current embodiment.

It should be appreciated that with the desired baffles 32, 36, 42 installed in the inner element 24, and the inner element installed in the outer sleeve 30, the interior space 14 is divided by the baffles into a blast chamber 50 and a series of following chambers 52. The blast chamber is in communication with a pair of opposed blast chamber vents 54 defined by the inner element, and each of the following chambers is in communication with a pair of opposed following chamber vents 56 defined by the inner element.

Figure 2:
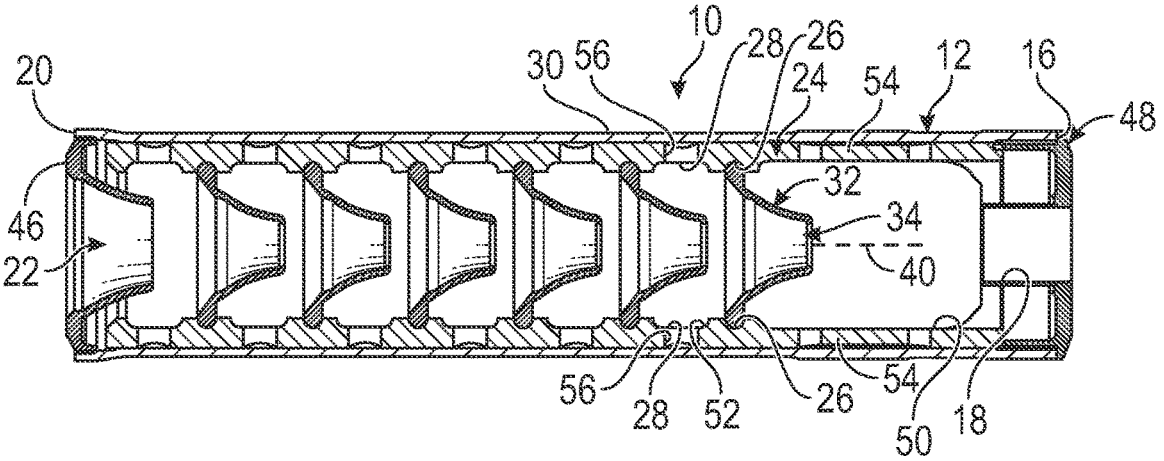
FIG. 2 is side sectional view of the firearm silencer of FIG. 1 with only the first set of baffles installed in the inner element for use with a smaller caliber firearm.

FIG. 2 illustrates the improved firearm silencer 10 of the present invention. More particularly, FIG. 2 shows the firearm silencer configured for use with the first set of baffles 32 for smaller caliber firearms. In this configuration, a single baffle from the first set of baffles is securely received in each of the smaller baffle receptacles 26, which are sized for that purpose. The first diameter of the bullet passages 34 is closely sized to fit the projectile fired by a smaller caliber firearm. The close fit ensures optimal noise reduction effectiveness of the firearm silencer.

Figure 3:
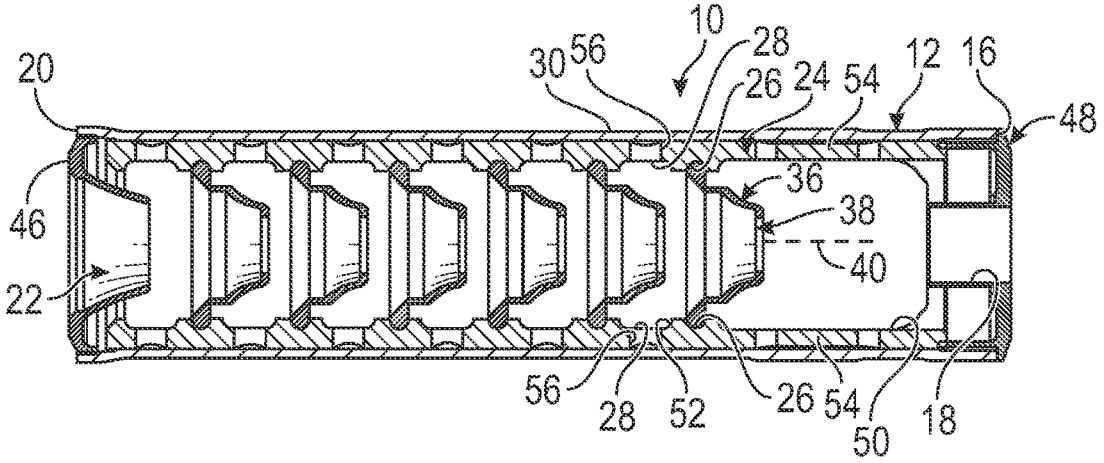
FIG. 3 is side sectional view of the firearm silencer of FIG. 1 with only the second set of baffles installed in the inner element for use with a medium caliber firearm.

FIG. 3 illustrates the improved firearm silencer 10 of the present invention. More particularly, FIG. 3 shows the firearm silencer configured for use with the second set of baffles 36 for medium caliber firearms. In this configuration, a single baffle from the second set of baffles is securely received in each of the smaller baffle receptacles 26, which are sized for that purpose. The second diameter of the bullet passages 38, which is larger than the first diameter of the bullet passages 34 of the first set of baffles 32, is closely sized to fit the projectile fired by a medium caliber firearm. The close fit ensures optimal noise reduction effectiveness of the firearm silencer. If desired, use of a set of baffles one size larger than the smallest compatible with the fired projectile significantly reduces the gas blow back for smaller calibers, rate of fire on full automatic, and wear and tear on the weapon system.

Figure 4:
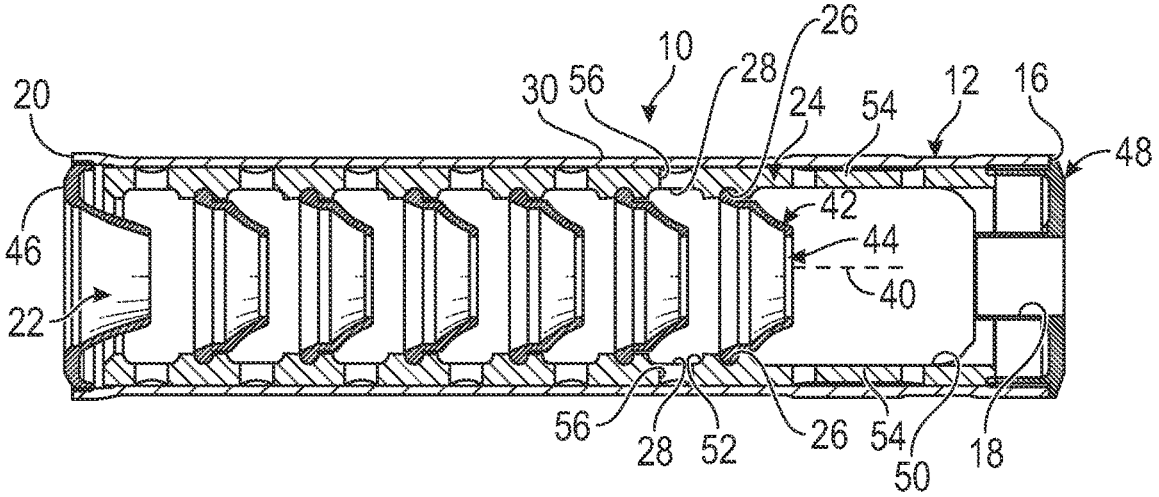
FIG. 4 is side sectional view of the firearm silencer of FIG. 1 with only the third set of baffles installed in the inner element for use with a larger caliber firearm.

FIG. 4 illustrates the improved firearm silencer 10 of the present invention. More particularly, FIG. 4 shows the firearm silencer configured for use with the third set of baffles 42 for larger caliber firearms. In this configuration, a single baffle from the third set of baffles is securely received in each of the smaller baffle receptacles 26, which are sized for that purpose. The third diameter of the bullet passages 44, which is larger than the second diameter of the bullet passages 38 of the second set of baffles 36, is closely sized to fit the projectile fired by a larger caliber firearm. The close fit ensures optimal noise reduction effectiveness of the firearm silencer.

Figure 5:
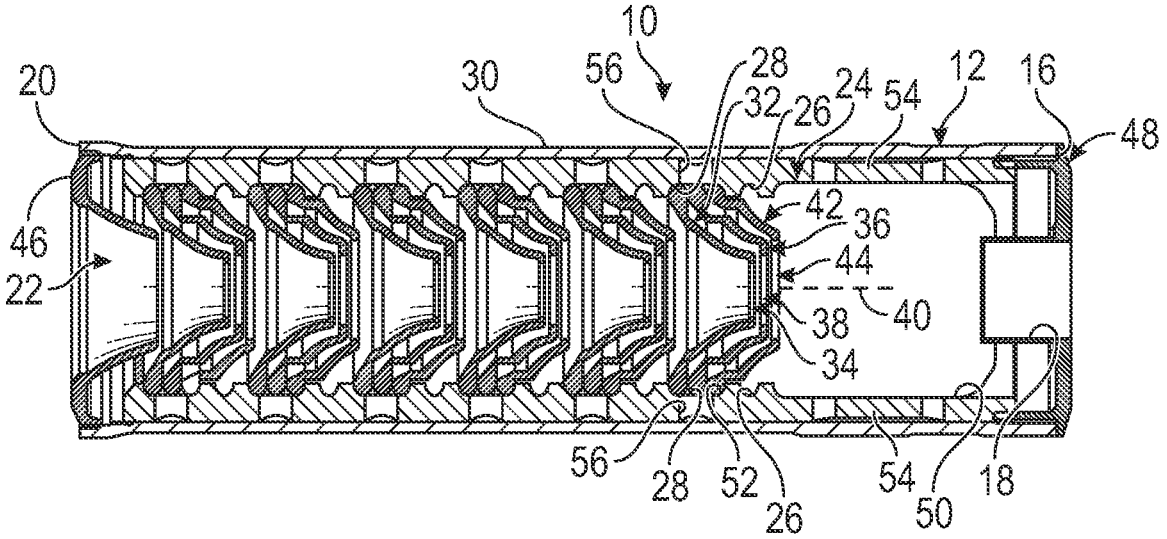
FIG. 5 is side sectional view of the firearm silencer of FIG. 1 with all three sets of baffles installed in the inner element for shipping, storage, and use with a smaller caliber firearm.

FIG. 5 illustrates the improved firearm silencer 10 of the present invention. More particularly, FIG. 5 shows how all of the sets of baffles 32, 36, 42 can be contained within the firearm silencer for shipment and storage, as well as usage with a small caliber firearm. In this configuration, the three sets of baffles are nested in stacks consisting of one of each type of baffle. Each stack is securely received by one of the larger baffle receptacles 28, which are sized for that purpose. For the majority of users, both civilian and law enforcement, three caliber classes of baffles are sufficient. In the current embodiment, the caliber classes of the three sets of baffles are 0.17-0.224, 0.243-0.357/9 mm, and 0.40-0.458. However, the concepts disclosed herein are valid for any range of caliber classes. Because the inner element 24 will hold all three sets of baffles included with the firearm silencer, and the firearm silencer is usable with a smaller caliber firearm in that configuration, there are no "extra parts," making the firearm silencer compliant with NFA rules and economical to acquire. However, it should be appreciated that it may be preferable to use the firearm silencer in the configuration illustrated in FIG. 2 with smaller caliber firearms to minimize the weight of the firearm silencer and decrease the number of baffles that would require cleaning after use.

Figure 6:
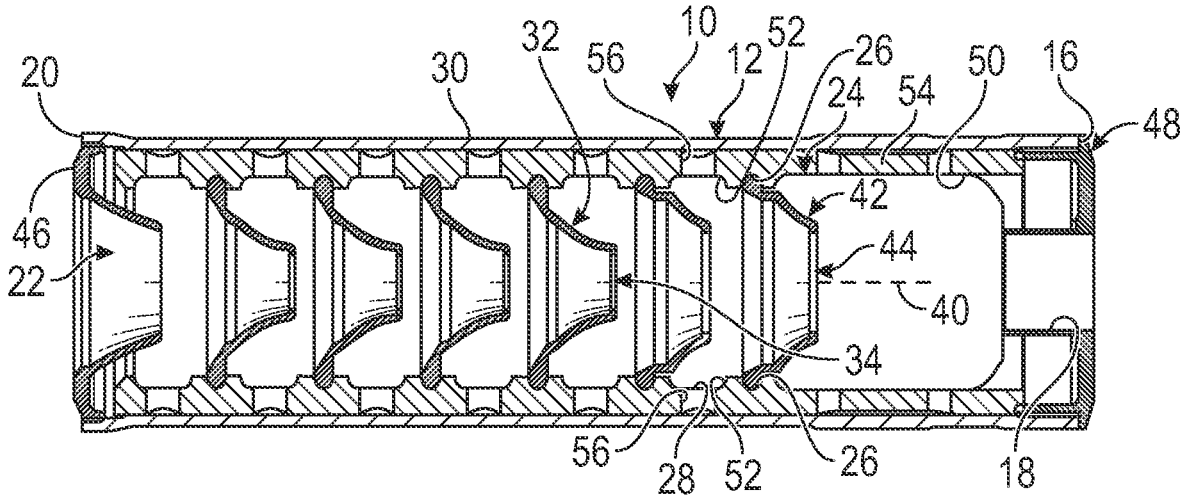
FIG. 6 is a side sectional view of the firearm silencer of FIG. 1 with two baffles from the third set of baffles followed by four baffles from the first set of baffles installed in the inner element for use to apply reduced back gas pressure to the gas system of a smaller caliber semi-automatic or fully-automatic firearm.

FIG. 6 illustrates the improved firearm silencer 10 of the present invention. More particularly, FIG. 6 shows using baffles from more than one of the three sets of baffles 32, 36, 42 can achieve a desirable performance characteristic of the firearm silencer with the limitation that the diameter of the baffles must be large enough to permit passage of the projectile to be fired. As is shown, two baffles 42 from the third set of baffles are placed in the two baffle receptacles 26 closest to the rear end 16 of the firearm silencer followed by four baffles from the first set of baffles 32 in the remaining baffle receptacles 26. This configuration reduces the back gas pressure applied to the gas system of the attached semi-automatic or fully-automatic smaller caliber firearm. Specifically, the larger diameter of the bullet passages 44 of the first two baffles encountered by the bullet (not shown) prevent a spike in gas pressure in the blast chamber 50 and rearmost following chamber 52. This allows the gases to flow through the firearm silencer 10 more easily than if the bullet passages had smaller diameters. For an attached direct gas impingement firearm, this spike in gas pressure would result in an undesirably high rate of fire on full automatic and a substantial amount of gas blow back out of the ejection port. This configuration could be extended to three or four baffles 42 depending on the firearm's barrel length, caliber, and desired rate of fire.

In the context of the specification, the terms "rear" and "rearward," and "front" and "forward," have the following definitions: "rear" or "rearward" means in the direction towards the shooter while "front" or "forward" means it is in the direction towards the target of the firearm.

While a current embodiment of a firearm silencer has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm silencer comprising:

an elongated body defining an interior space and having a rear end with a mounting facility, and a forward end defining an exit aperture;

the elongated body defining a plurality of baffle receptacles in the interior space;

a first set of baffles received in some of the baffle receptacles;

at least a second set of baffles received in some of the baffle receptacles;

the first set of baffles and the second set of baffles being simultaneously received in the baffle receptacles;

at least some of the baffles of the first set defining a bullet passage having a first diameter;

at least some of the baffles of the second set defining a bullet passage having a second diameter different from the first diameter;

at least some of of the baffle receptacles configured to securely receive all of the baffles of the first and second sets;

at least some of the baffle receptacles configured to securely receive all of the baffles of the first set and none of the second set; and at least some of the baffle receptacles configured to securely receive all of the baffles of the second set and none of the first set.

2. The firearm silencer of claim 1 including both sets of baffles in the baffle receptacles.

3. The firearm silencer of claim 2 wherein the bullet passages of all the baffles are registered with each other on a line.

4. The firearm silencer of claim 1 including all the baffles of only one of the first and second sets spaced apart over a majority of the length of the elongated body.

5. The firearm silencer of claim 1 wherein at least some of the baffle receptacles are configured to closely receive a stack of a plurality of baffles.

6. The firearm silencer of claim 5 wherein at least some of the baffle receptacles are configured to closely receive only a single baffle.

7. The firearm silencer of claim 1 wherein the baffle receptacles are defined as transverse slots in the elongated body.

8. The firearm silencer of claim 1 wherein the elongated body includes an inner element defining the baffle receptacles, and an outer sleeve encompassing the inner element.

9. The firearm silencer of claim 1 including at least five baffles in each set.

10. The firearm silencer of claim 1 including a third set of baffles defining a bullet passage having a third diameter different from the first and second diameters.

11. A firearm silencer comprising:

an elongated body defining an interior space and having a rear end with a mounting facility, and a forward end defining an exit aperture;

the elongated body defining a first plurality of baffle receptacles in the interior space;

a plurality of baffles securely received in the first plurality of baffle receptacles;

the body defining a second plurality of baffle receptacles in the interior space;

the second plurality of baffle receptacles each configured to securely receive at most half of the baffles with a remainder of baffles removed from the elongated body;

wherein each of the first plurality of baffle receptacles is configured to receive a stack of at least two baffles; and wherein each of the second plurality of baffle receptacles is configured to closely receive only a single baffle.

12. The firearm silencer of claim 11 wherein the second plurality of baffle receptacles are in a spaced-apart arrangement along a majority of the length of the elongated body.

13. The firearm silencer of claim 11 wherein each of the first plurality of baffle receptacles has a width that is an integral multiple of a width of each of the second baffle receptacles.

14. The firearm silencer of claim 11 wherein the baffle receptacles are defined as transverse slots in the elongated body.

15. The firearm silencer of claim 11 wherein the elongated body includes an inner element defining the baffle receptacles, and an outer sleeve encompassing the inner element.

* * * * *